US007673689B2

(12) United States Patent
Jackson et al.

(10) Patent No.: US 7,673,689 B2
(45) Date of Patent: Mar. 9, 2010

(54) DUAL FLAPPER BARRIER VALVE

(75) Inventors: Stephen L. Jackson, Richmond, TX (US); Michael Foster, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 109 days.

(21) Appl. No.: 11/761,229

(22) Filed: Jun. 11, 2007

(65) Prior Publication Data

US 2007/0284119 A1 Dec. 13, 2007

Related U.S. Application Data

(60) Provisional application No. 60/804,547, filed on Jun. 12, 2006.

(51) Int. Cl.
*E21B 34/12* (2006.01)

(52) U.S. Cl. ..... 166/332.8; 166/373; 166/386

(58) Field of Classification Search ..... 166/373–375, 166/316, 319, 321, 323, 325, 332.1, 332.7, 166/332.8; 251/298
See application file for complete search history.

(56) References Cited

U.S. PATENT DOCUMENTS 4,161,985 A 7/1979 Fournier et al.
4,926,945 A 5/1990 Pringle et al.
5,095,937 A * 3/1992 LeBlanc et al. ..... 137/423
5,372,193 A 12/1994 French
5,810,087 A 9/1998 Patel
5,857,523 A * 1/1999 Edwards ..... 166/374
5,950,733 A 9/1999 Patel
6,015,014 A 1/2000 Macleod et al.
6,152,224 A 11/2000 French
6,220,355 B1 4/2001 French
6,230,808 B1 5/2001 French et al.

(Continued)

FOREIGN PATENT DOCUMENTS

GB 2 313 610 12/1997

(Continued)

OTHER PUBLICATIONS

GB Search Report, Application No. GB0711156.0, dated Jan. 15, 2008.

(Continued)

*Primary Examiner*—Kenneth Thompson
(74) *Attorney, Agent, or Firm*—Patterson & Sheridan, L.L.P.

(57) ABSTRACT

The present invention generally relates to a wellbore tool for selectively isolating a portion of a wellbore from another portion of the wellbore. In one aspect, a method of selectively isolating a zone in a wellbore is provided. The method includes the step of positioning a downhole tool in the wellbore. The downhole tool includes a bore with a first flapper member and a second flapper member disposed therein, whereby each flapper member is initially in an open position. The method also includes the step of moving the first flapper member to a closed position by rotating the first flapper member in one direction. Further, the method includes the step of moving the second flapper member to a closed position by rotating the second flapper member in an opposite direction, whereby each flapper member is movable between the open position and the closed position multiple times. In another aspect, an apparatus for isolating a zone in a wellbore is provided.

16 Claims, 6 Drawing Sheets

U.S. PATENT DOCUMENTS

| | | | | |
|---|---|---|---|---|
| 6,286,594 | B1 | 9/2001 | French | |
| 6,289,991 | B1 | 9/2001 | French | |
| 6,494,269 | B2 | 12/2002 | French et al. | |
| 6,508,309 | B1 | 1/2003 | French | |
| 6,595,296 | B1 | 7/2003 | French | |
| 6,840,321 | B2 * | 1/2005 | Restarick et al. | 166/313 |
| 6,904,975 | B2 | 6/2005 | Horne et al. | |
| 7,204,315 | B2 * | 4/2007 | Pia | 166/373 |
| 2004/0020657 | A1 | 2/2004 | Patel | |

FOREIGN PATENT DOCUMENTS

| | | |
|---|---|---|
| GB | 2 411 193 | 8/2005 |
| WO | WO 2006/081015 | 8/2006 |

OTHER PUBLICATIONS

Protecting Formations, FIV Technology, Schlumberger.

GB Search Report, Application No. GB0711156.0, dated Sep. 7, 2007.

Canadian Office Action, Canadian Patent Application No. 2,591,360, dated May 7, 2009.

* cited by examiner

DUAL FLAPPER BARRIER VALVE

CROSS-REFERENCE TO RELATED APPLICATIONS

This application claims benefit of U.S. provisional patent application Ser. No. 60/804,547, filed Jun. 12, 2006, which is herein incorporated by reference in its entirety.

BACKGROUND OF THE INVENTION

1. Field of the Invention

Embodiments of the present invention generally relate to wellbore completion. More particularly, the invention relates to a wellbore tool for selectively isolating a zone in a wellbore.

2. Description of the Related Art

A completion operation typically occurs during the life of a well in order to allow access to hydrocarbon reservoirs at various elevations. Completion operations may include pressure testing tubing, setting a packer, activating safety valves or manipulating sliding sleeves. In certain situations, it may be desirable to isolate a portion of the completion assembly from another portion of the completion assembly in order to perform the completion operation. Typically, a ball valve, which is referred to as a formation isolation valve (FIV), is disposed in the completion assembly to isolate a portion of the completion assembly.

Generally, the ball valve includes a valve member configured to move between an open position and a closed position. In the open position, the valve member is rotated to align a bore of the valve member with a bore of the completion assembly to allow the flow of fluid through the completion assembly. In the closed position, the valve member is rotated to misalign the bore in the valve member with the bore of the completion assembly to restrict the flow of fluid through the completion assembly, thereby isolating a portion of the completion assembly from another portion of the completion assembly. The valve member is typically hydraulically shifted between the open position and the closed position.

Although the ball valve is functional in isolating a portion of the completion assembly from another portion of the completion assembly, there are several drawbacks in using the ball valve in the completion assembly. For instance, the ball valve takes up a large portion of the bore in the completion assembly, thereby restricting the bore diameter of the completion assembly. Further, the ball valve is susceptible to debris in the completion assembly which may cause the ball valve to fail to operate properly. Additionally, if the valve member of the ball valve is not fully rotated to align the bore of the valve member with the bore of the completion assembly, then there is no full bore access of the completion assembly.

There is a need therefore, for a downhole tool that is less restrictive of a bore diameter in a completion assembly. There is a further need for a downhole tool that is debris tolerant.

SUMMARY OF THE INVENTION

The present invention generally relates to a wellbore tool for selectively isolating a portion of a wellbore from another portion of the wellbore. In one aspect, a method of selectively isolating a zone in a wellbore is provided. The method includes the step of positioning a downhole tool in the wellbore. The downhole tool includes a bore with a first flapper member and a second flapper member disposed therein, whereby each flapper member is initially in an open position.

The method also includes the step of moving the first flapper member to a closed position by rotating the first flapper member in one direction. Further, the method includes the step of moving the second flapper member to a closed position by rotating the second flapper member in an opposite direction, whereby each flapper member is movable between the open position and the closed position multiple times.

In another aspect, an apparatus for isolating a zone in a wellbore is provided. The apparatus includes a body having a bore formed therein. The apparatus also includes a first flapper member disposed in the bore. The first flapper member is selectively rotatable between an open position and a closed position multiple times, wherein the first flapper member is rotated from the open position to the closed position in one direction. The apparatus further includes a second flapper member disposed in the bore. The second flapper member is selectively rotatable between an open position and a closed position multiple times, wherein the second flapper member is rotated from the open position to the closed position in an opposite direction.

In yet another aspect, a method of isolating a first portion of a wellbore from a second portion of the wellbore is provided. The method includes the step of lowering a downhole tool in the wellbore. The downhole tool includes a first flapper member and a second flapper member, wherein each flapper member is initially in an open position and each flapper member is movable between the open position and a closed position multiple times. The method further includes the step of selectively isolating the first portion of the wellbore from the second portion of the wellbore by shifting the first flapper member to the closed position to hold pressure from below the first flapper member and shifting the second flapper member to the closed position to hold pressure from above the second flapper member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
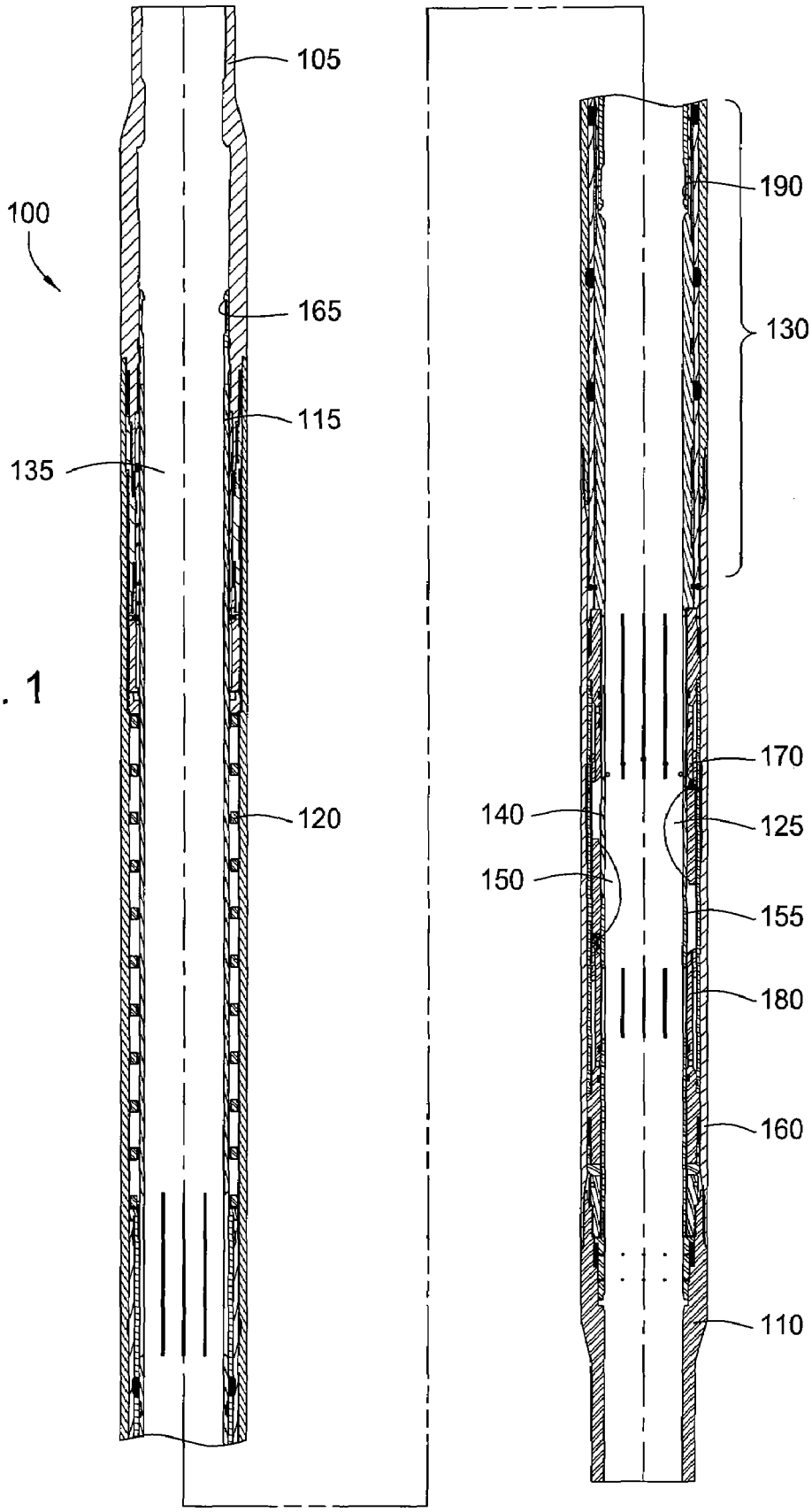
FIG. 1 is a cross-sectional view illustrating a downhole tool in a run-in position, wherein a first flapper valve and a second flapper valve are in an open position.

FIG. 1 is a cross-sectional view illustrating a downhole tool 100 in a run-in position. The tool 100 includes an upper sub 105, a housing 160 and a lower sub 110. The upper sub 105 is configured to be connected to an upper completion assembly (not shown), such as a packer arrangement. The lower sub 110 is configured to be connected to a lower completion assembly (not shown). Generally, the tool 100 is used to selectively isolate the upper completion assembly from the lower completion assembly.

The tool 100 includes a first flapper valve 125 and a second flapper valve 150. The valves 125, 150 are movable between an open position and a closed position multiple times. As shown in FIG. 1, the valves 125, 150 are in the open position when the tool 100 is run into the wellbore. Generally, the valves 125, 150 are used to open and close a bore 135 of the tool 100 in order to selectively isolate a portion of the wellbore above the tool 100 from a portion of the wellbore below the tool 100.

The valves 125, 150 move between the open position and the closed position in a predetermined sequence. For instance, in a closing sequence, the first flapper valve 125 is moved to the closed position and then the second flapper valve 150 is moved to the closed position as will be described in relation to FIGS. 1-3. In an opening sequence, the second flapper valve 150 is moved to the open position and then the first flapper valve 125 is moved to the open position as will be described in relation to FIGS. 6-8. The predetermined sequence allows the tool 100 to function properly. For example, in the opening sequence, the flapper valve 150 is moved to the open position first in order to allow the flapper valve 150 to open in a substantially clean environment defined between the flapper valves 125, 150, since the flapper valve 125 is configured to substantially block debris from contacting the flapper valve 150 when the flapper valve 125 is in the closed position. In the closing sequence, the flapper valve 125 is moved to the closed position first in order to substantially protect the flapper valve 150 from debris that may be dropped from the surface of the wellbore.

As illustrated in FIG. 1, the first flapper valve 125 is held in the open position by an upper flow tube 140 and the second flapper valve 150 is held in the open position by a lower flow tube 155. It should be noted that the flapper valves 125, 150 may be a curved flapper valve, a flat flapper valve, or any other known flapper valve without departing from principles of the present invention. Further, the opening and closing orientation of the valves 125, 150 may be rearranged into any configuration without departing from principles of the present invention. Additionally, the flapper valve 150 may be positioned at a location above the flapper valve 125 without departing from principles of the present invention.

The tool 100 includes a shifting sleeve 115 with a profile 165 proximate an end thereof and a profile 190 proximate another end thereof. The tool 100 also includes a biasing member 120, such as a spring. The tool 100 further includes a shift and lock mechanism 130. As discussed herein, the shift and lock mechanism 130 interacts with the biasing member 120, the shifting sleeve 115, and the flow tubes 140, 155 in order to move the flapper valves 125, 150 between the open position and the closed position.

Figure 2:
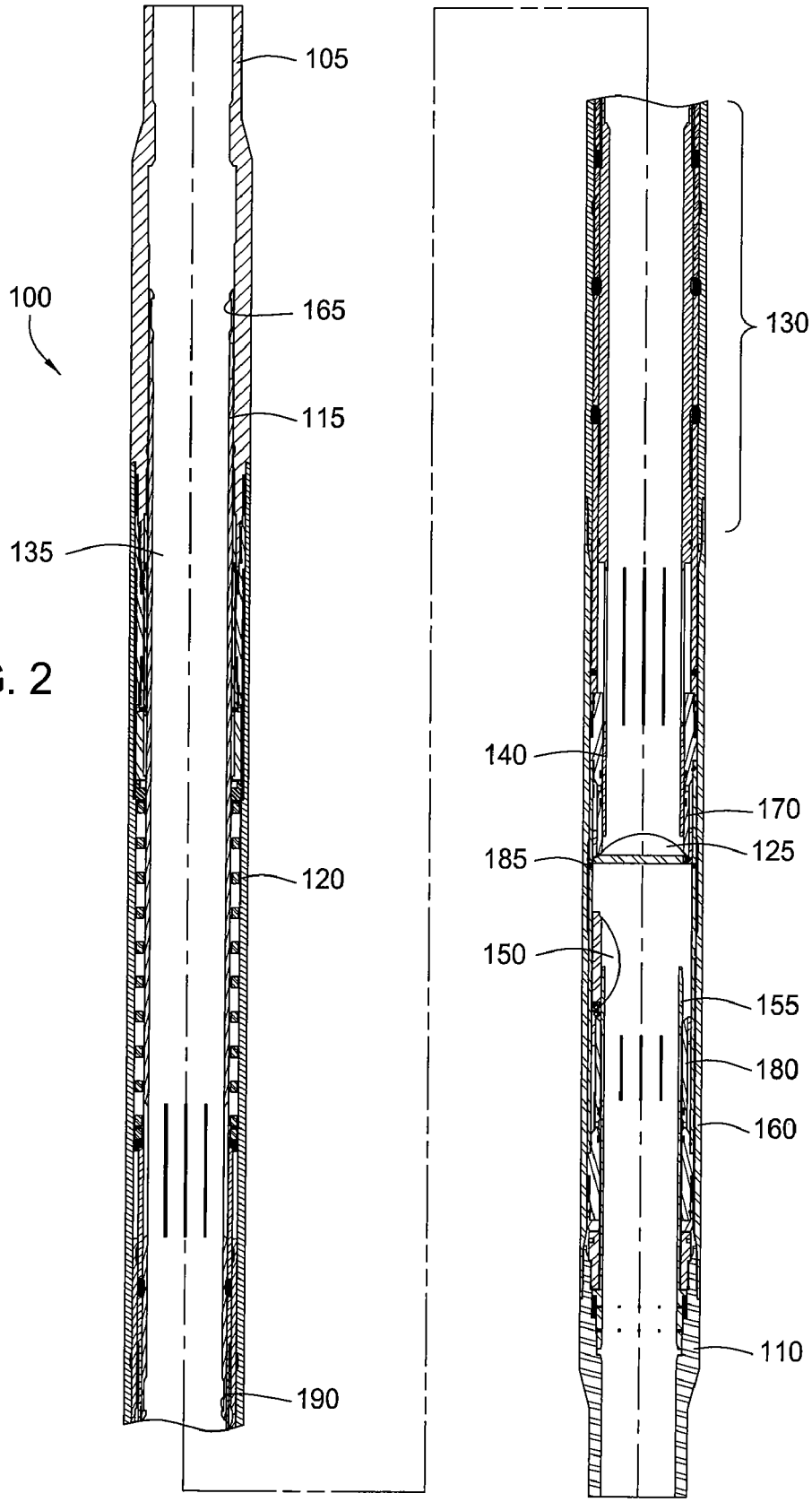
FIG. 2 is a cross-sectional view illustrating the first flapper valve in a closed position.
Figure 3:
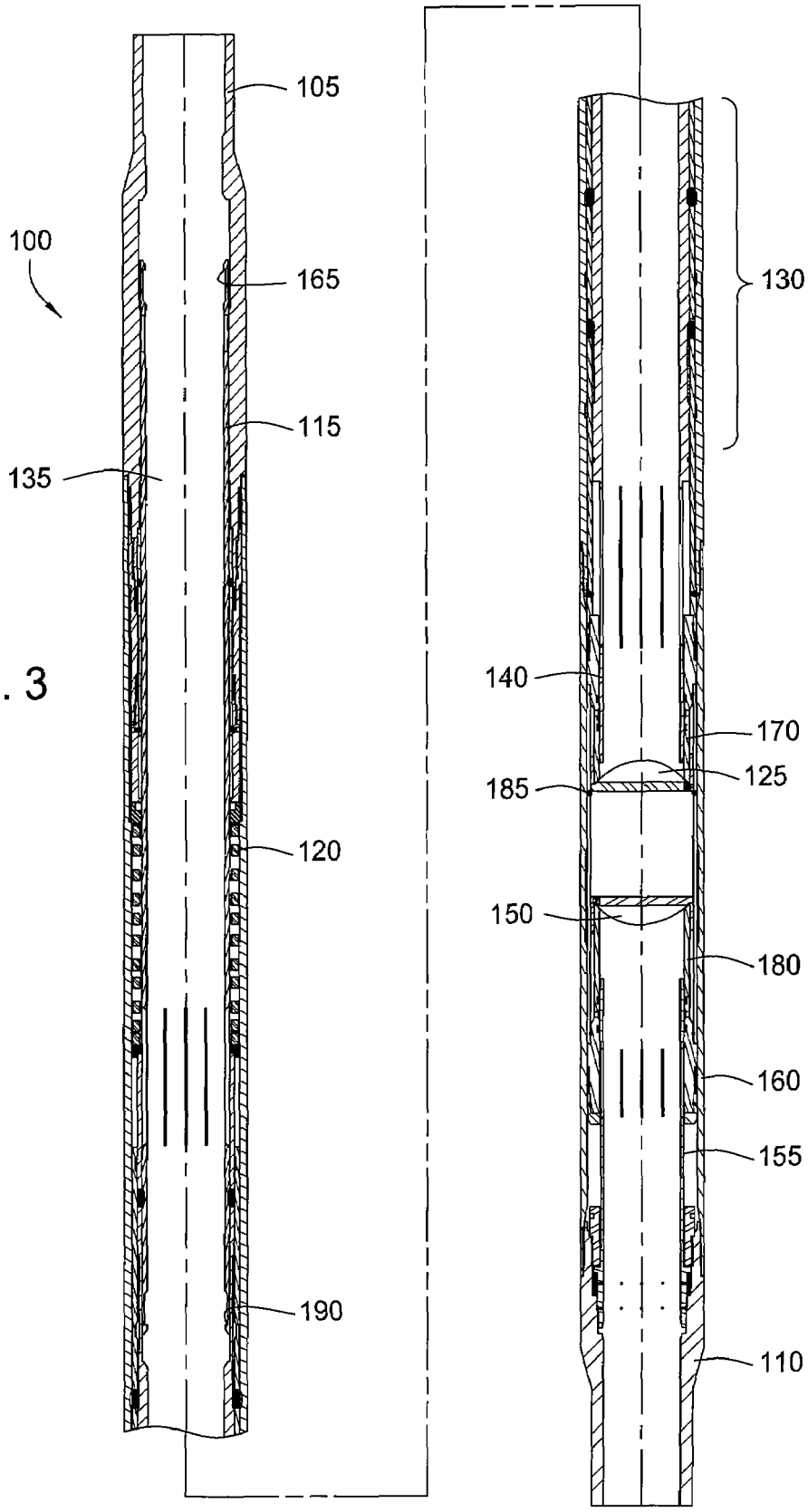
FIG. 3 is a cross-sectional view illustrating the second flapper valve in a closed position.

As shown in FIG. 1, the shift and lock mechanism 130 is a key and dog arrangement, whereby a plurality of dogs move in and out of a plurality of keys formed in the sleeves as the sleeves are shifted in the tool 100 as illustrated in FIGS. 1-3. The movement of the dogs and the sleeves causes the flapper valves 125, 150 to move between the open and the closed position. It should be understood, however, that the shift and lock mechanism 130 may be any type of arrangement capable of causing the flapper valves 125, 150 to move between the open and the closed position without departing from principles of the present invention. For instance, the shift and lock mechanism 130 may be a motor that is actuated by a hydraulic control line or an electric control line. The shift and lock mechanism 130 may be an arrangement that is controlled by fiber optics, a signal from the surface, an electric line, or a hydraulic line. Further, the shift and lock mechanism 130 may be an arrangement that is controlled by a pressure differential between an annulus and a tubing pressure or a pressure differential between a location above and below the tool 100.

FIG. 2 is a cross-sectional view illustrating the first flapper valve 125 in the closed position. In the closing sequence, the flapper valve 125 is moved to the closed position first in order to protect the flapper valve 150 from debris that may be dropped from the surface of the wellbore. In one embodiment, a shifting tool (not shown) having a plurality of fingers that mates with the profile 165 of the sleeve 115 is used to move the first flapper valve 125 to the closed position. The shifting tool may be a mechanical tool that is initially disposed below the tool 100 and then urged through the bore 135 of the tool 100 until it mates with the profile 165. The shifting tool may also be a hydraulic shifting tool that includes fingers that selectively extend radially outward due to fluid pressure and mate with the profile 165. In either case, the shifting tool mates with the profile 165 in order to pull the sleeve 115 toward the upper sub 105.

As the sleeve 115 begins to move toward the upper sub 105, the shift and lock mechanism 130 unlocks the flapper valves 125, 150. Thereafter, the shift and lock mechanism 130 moves the flow tube 140 away from the flapper valve 125. At that time, a biasing member (not shown) attached to a flapper member in the flapper valve 125 rotates the flapper member around a pivot point until the flapper member contacts and creates a sealing relationship with a valve seat 170. As illustrated, the flapper member closes away from the lower sub 110. As such, the flapper valve 125 is configured to seal from below. In other words, the flapper valve 125 is capable of substantially preventing fluid flow from moving upward through the tool 100. In addition, as the sleeve 115 moves toward the upper sub 105, the biasing member 120 is also compressed.

As the shifting tool urges the sleeve 115 further toward the upper sub 105, a locking mechanism 185 is activated to secure the flapper valve 125 in the closed position. The locking mechanism 185 may be any known locking mechanism, such as a ball and sleeve arrangement, pins, or a series of extendable fingers. The locking mechanism 185 is configured to allow the flapper valve 125 to burp or crack open if necessary. This situation may occur when debris from the surface of the wellbore falls and lands on the flapper valve 125. It should be noted that the locking mechanism 185 will not allow the flapper valve 125 to move to the full open position, as shown in FIG. 1, but rather the locking mechanism 185 will only allow the flapper valve 125 to crack open slightly. As such, the flapper valve 125 in the closed position acts a barrier member to the flapper valve 150 by substantially preventing large particles (i.e. a dropped drill string) from contacting and damaging the flapper valve 150.

FIG. 3 is a cross-sectional view illustrating the second flapper valve 150 in the closed position. After the flapper valve 125 is in the closed position and secured in place, the shifting tool continues to urge the sleeve 115 toward the upper sub 105. At the same time, the flapper valve 150 is moved away from the flow tube 155, thereby allowing a biasing member (not shown) attached to a flapper member in the flapper valve 150 to rotate the flapper member around a pivot point until the flapper member contacts and creates a sealing relationship with a valve seat 180. As illustrated, the flapper member closes away from the upper sub 105. As such, the flapper valve 150 is configured to seal from above. In other words, the flapper valve 150 is capable of substantially preventing fluid flow from moving downward through the tool 100. Thereafter, the sleeve 115 is urged closer to the upper sub 105 and the flapper valves are locked in place by the shift and lock mechanism 130. Also, the biasing member 120 is in a full compressed state.

Figure 4:
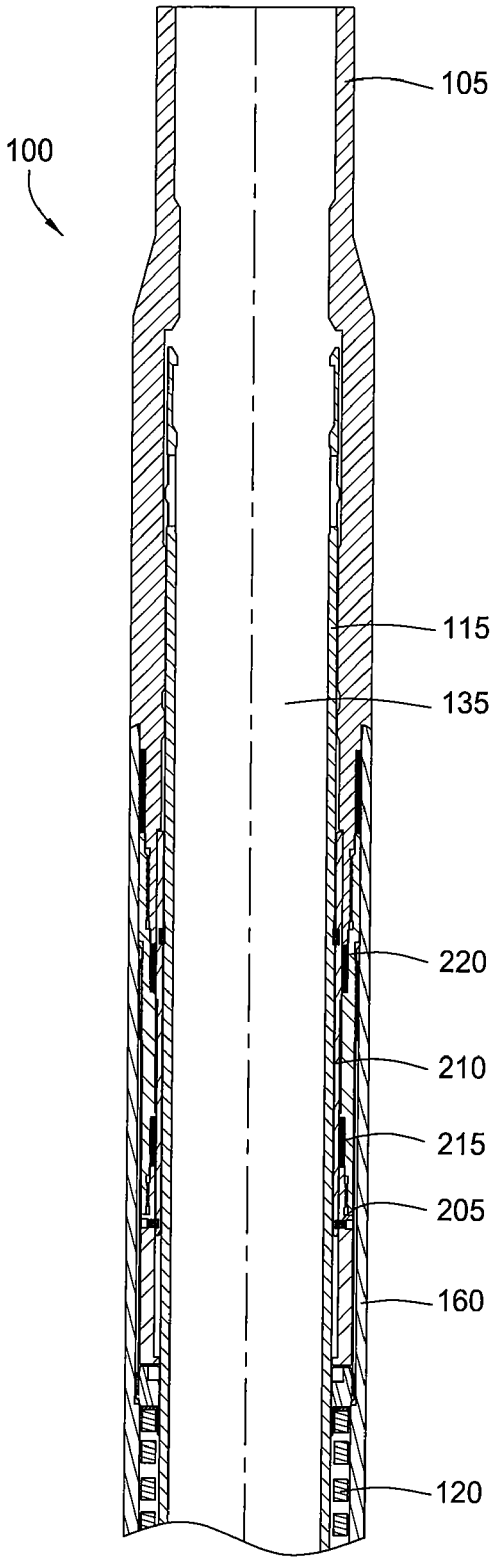
FIGS. 4 and 5 are cross-sectional views illustrating a hydraulic chamber arrangement.
Figure 5:
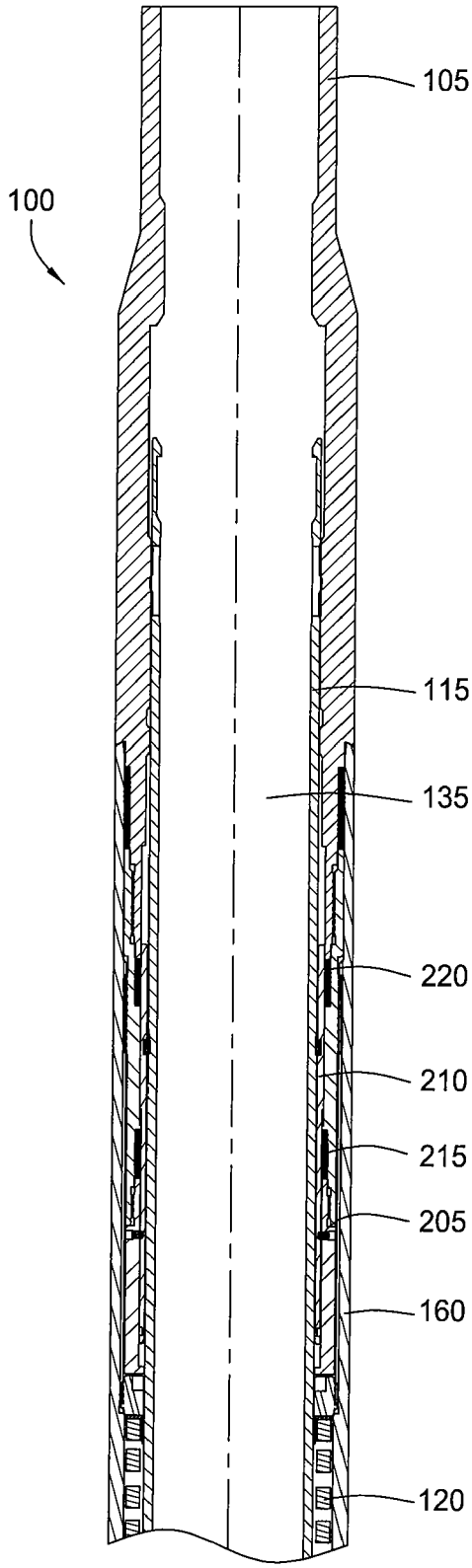

FIGS. 4 and 5 are cross-sectional views illustrating a hydraulic chamber arrangement. The flapper valves 125, 150 in the downhole tool 100 are moved to the open position by actuating the shift and lock mechanism 130. In the embodiment illustrated in FIGS. 4 and 5, the shift and lock mechanism 130 is actuated when a pressure differential between an ambient chamber 210 and tubing pressure in the bore 135 of the tool 100 reaches a predetermined pressure. The chamber 210 is formed at the surface between two seals 215, 220. As the tool 100 is lowered into the wellbore, a hydrostatic pressure is developed which causes a pressure differential between the pressure in the chamber 210 and the bore 135 of the tool 100. As illustrated in FIG. 5, at a predetermined differential pressure, a shear pin 205 is sheared, thereby causing the biasing member 120 to uncompress and shift the sleeve 115 toward the lower sub 110 in order to unlock the flapper valves 125, 150 and start the opening sequence. The shear pin 205 may be selected based upon the depth location in the wellbore that the shift and lock mechanism 130 is to be actuated.

Figure 6:
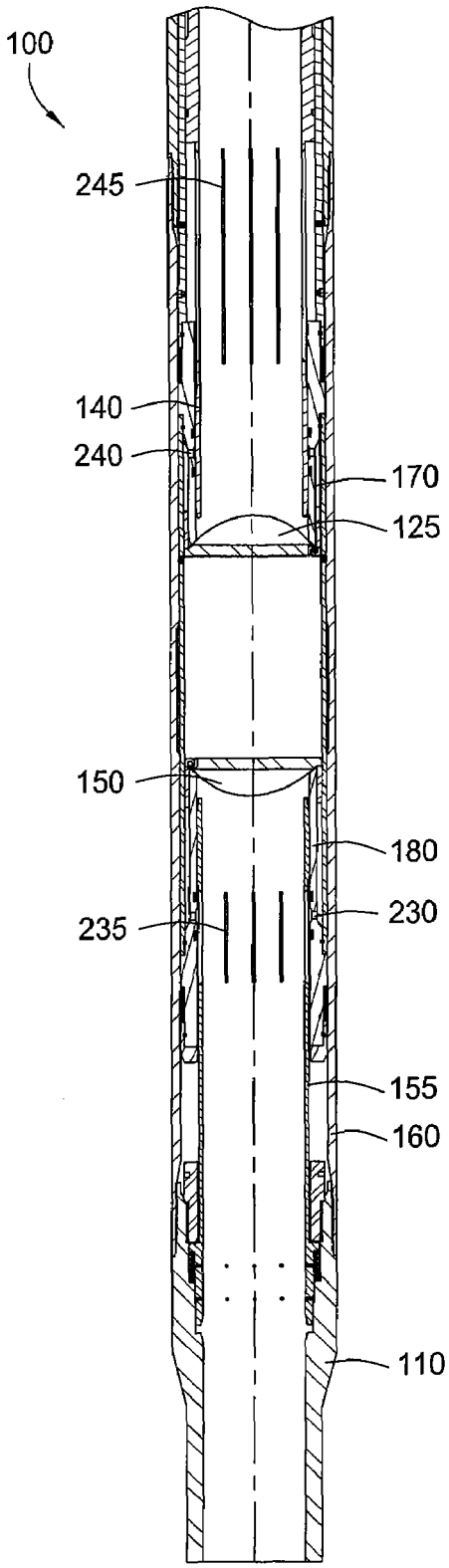
FIGS. 6 and 7 are cross-sectional views illustrating the second flapper valve being moved to the open position.
Figure 7:
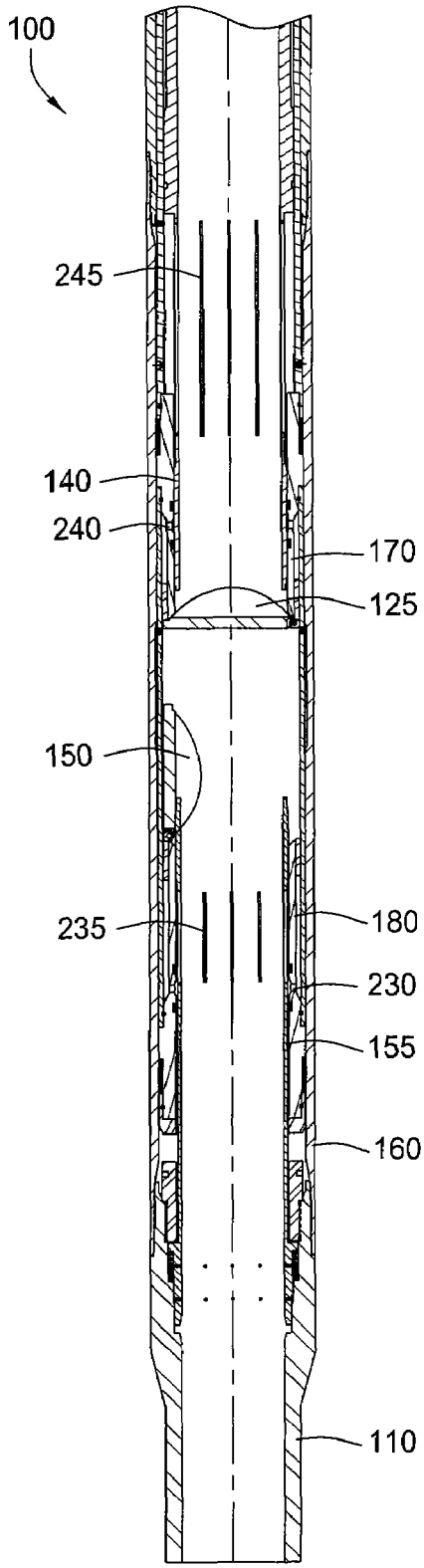

FIGS. 6 and 7 are cross-sectional views illustrating the flapper valve 125 being moved to the open position. As previously set forth, in the opening sequence, the flapper valve 150 is moved to the open position first in order to allow the flapper valve 150 to open in a clean environment. However, prior to moving the flapper valve 150 to the open position, the flapper valves 125 and 150 are unlocked by manipulating the shift and lock mechanism 130. Next, the pressure around the flapper valve 150 is equalized by aligning a port 230 with a slot 235 formed in the flow tube 155 as the sleeve 115 is moved toward the lower sub 110. Thereafter, further movement of the sleeve 115 toward the lower sub 110 causes the flapper valve 150 to contact the flow tube 155 which will subsequently cause the flapper valve 150 to move from the closed position to the open position as shown in FIG. 7. As previously discussed, the movement of the sleeve 115 toward the lower sub 110 may be accomplished by a variety of means. For instance, the sleeve 115 may be urged toward the lower sub 110 by a hydraulic or mechanical shifting tool (not shown) that interacts with the profile 190 formed on the sleeve 115. In turn, the sleeve 115 manipulates the mechanism 130 in order to open the flapper valves 125, 150.

The flapper valves 125, 150 in the downhole tool 100 are moved to the open position by manipulating the shift and lock mechanism 130. As discussed herein, in one embodiment, the shift and lock mechanism 130 is a key and dog arrangement, whereby the plurality of dogs move in and out of the plurality of keys formed in the sleeves as the sleeves are shifted in the tool 100 as illustrated in FIGS. 1-3. The movement of the dogs and the sleeves causes the flapper valves 125, 150 to move between the open and the closed position. It should be understood, that the shift and lock mechanism 130 is not limited to this embodiment. Rather, the shift and lock mechanism 130 may be any type of arrangement capable of causing the flapper valves 125, 150 to move between the open and the closed position, such as a motor that is controlled by a hydraulic or electric control line from the surface. The shift and lock mechanism 130 may also be an arrangement that is controlled by fiber optics, a signal from the surface, an electric line, or a hydraulic line. Further, the shift and lock mechanism 130 may be an arrangement that is controlled by a pressure differential between an annulus and a tubing pressure or a pressure differential between a location above and below the tool 100.

Figure 8:
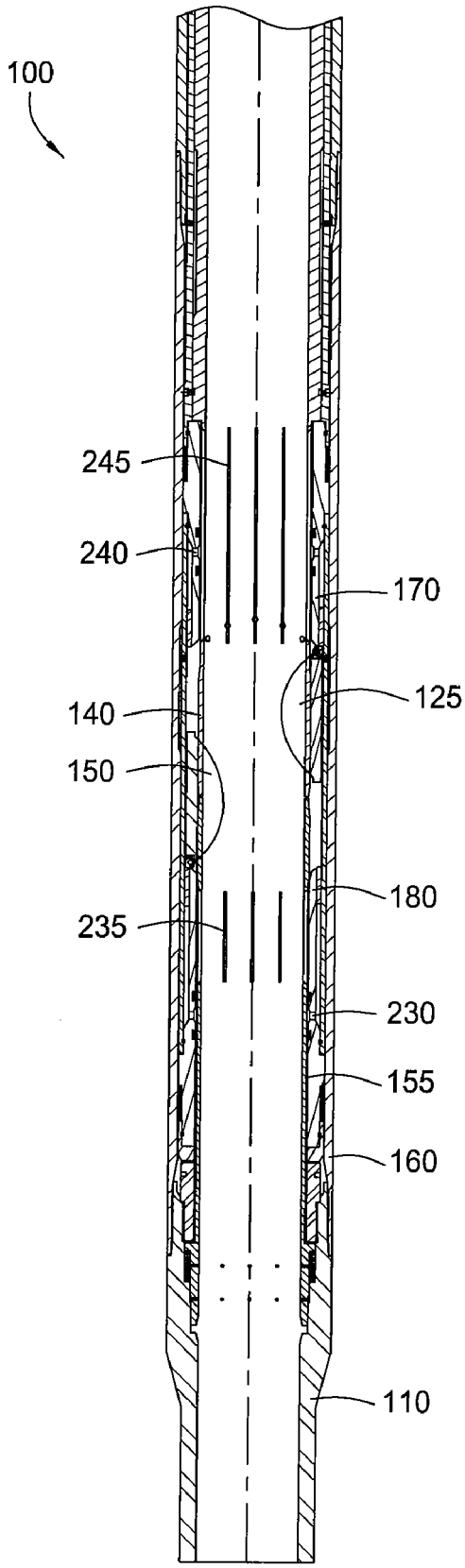
FIG. 8 is a cross-sectional view illustrating the first flapper valve in the open position.

FIG. 8 is a cross-sectional view illustrating the first flapper valve 125 in the open position. After the flapper valve 150 is opened, the flow tube 140 moves toward the flapper valve 125 as the shift and lock mechanism 130 is manipulated. Prior to the flow tube 140 contacting the flapper member in the flapper valve 125, a slot 245 formed in the flow tube 140 aligns with a port 240 to equalize the pressure around the flapper valve 125. Thereafter, the flow tube 140 contacts the flapper member in the flapper valve 125 and causes the flapper valve 125 to move from the closed position to the open position. Subsequently, the flapper valves 125, 150 are locked in place by further manipulation of the shift and lock mechanism 130. The process of moving the flapper valves 125, 150 between the open position and the closed position may be repeated any number of times.

While the foregoing is directed to embodiments of the present invention, other and further embodiments of the invention may be devised without departing from the basic scope thereof, and the scope thereof is determined by the claims that follow.

The invention claimed is:

1. A method of selectively isolating a zone in a wellbore, the method comprising:

positioning a downhole tool in the wellbore, the downhole tool having a bore with a first flapper member disposed in an upper portion and a second flapper member disposed in a lower portion of the bore, whereby each flapper member is in an open position;

moving the first flapper member to a closed position by rotating the first flapper member in one direction;

moving the second flapper member to a closed position by rotating the second flapper member in an opposite direction;

rotating the second flapper member from the closed position to the open position; and rotating the first flapper member from the closed position to the open position wherein the first flapper member is rotated to the open position after the second flapper member is in the open position.

2. The method of claim 1, wherein the first flapper is rotated toward an upper end of the tool to close the first flapper member and the second flapper member is rotated toward a lower end of the tool to close the second flapper member.

3. The method of claim 1, wherein the second flapper member is rotated to the closed position after the first flapper member is in the closed position.

4. The method of claim 1, further including equalizing the pressure around the first flapper member prior to rotating the first flapper member to the open position.

5. The method of claim 1, wherein the second flapper member is rotated to the open position in a substantially clean environment since the second flapper member is rotated prior to the rotation of the first flapper member to the open position.

6. The method of claim 1, wherein the first flapper member is configured to substantially protect the second flapper member from debris when the first flapper member is in the closed position.

7. The method of claim 1, wherein the first flapper member is configured to substantially restrict the flow of fluid in the bore from a lower end of the tool to an upper end of the tool.

8. The method of claim 1, wherein the second flapper member is configured to substantially restrict the flow of fluid in the bore from an upper end of the tool to a lower end of the tool.

9. A method of isolating a first portion of a wellbore from a second portion of the wellbore, the method comprising:

lowering a downhole tool in the wellbore, the downhole tool having a first flapper member disposed in an upper portion and a second flapper member disposed in a lower portion of the downhole tool, wherein each flapper member is in an open position; and selectively isolating the first portion of the wellbore from the second portion of the wellbore by rotating the first flapper member toward an upper end of the tool to a closed position to hold pressure from below the first flapper member and rotating the second flapper member toward a lower end of the tool to a closed position to hold pressure from above the second flapper member.

10. The method of claim 9, wherein the second flapper member is shifted to the closed position after the first flapper member is in the closed position.

11. The method of claim 9, further including shifting the second flapper member from the closed position to the open position and then shifting the first flapper member from the closed position to the open position.

12. The method of claim 9, further including selectively opening the first portion and the second portion of the wellbore by shifting the second flapper member to the open position and then shifting the first flapper member to the open position.

13. The method of claim 9, wherein each flapper member is movable between the open position and the closed position multiple times

14. The method of claim 1, wherein each flapper member is movable between the open position and the closed position multiple times

15. A method of selectively isolating a zone in a wellbore, the method comprising:

positioning a downhole tool in the wellbore, the downhole tool having a bore with a first flapper member and a second flapper member disposed therein, whereby each flapper member is in an open position;

moving the first flapper member to a closed position by rotating the first flapper member in one direction;

moving the second flapper member to a closed position by rotating the second flapper member in an opposite direction, whereby each flapper member is movable between the open position and the closed position multiple times; and equalizing the pressure around the second flapper member and then rotating the second flapper member to the open position.

16. A method of selectively isolating a zone in a wellbore, the method comprising:

positioning a downhole tool in the wellbore, the downhole tool having a bore with a first flapper member and a second flapper member disposed therein, whereby each flapper member is in an open position;

moving the first flapper member to a closed position by rotating the first flapper member in one direction;

moving the second flapper member to a closed position by rotating the second flapper member in an opposite direction, whereby each flapper member is movable between the open position and the closed position multiple times; and locking the first flapper member in the closed position by a locking member, wherein the locking member is configured to allow the first flapper member to open slightly.

* * * * *